US005669215A

United States Patent [19]

Spindler et al.

[11] Patent Number: 5,669,215

[45] Date of Patent: Sep. 23, 1997

[54] COMBINED PNEUMATIC YARN ATTENDING FOR TEXTILE MACHINES

[75] Inventors: Zdenek Spindler, B. Nemcove; Vojtech Novotny, Dukelska, both of Czech Rep.

[73] Assignee: Rieter Deutschland GmbH, Ingolstadt, Germany

[21] Appl. No.: 510,445

[22] Filed: Aug. 2, 1995

[30] Foreign Application Priority Data

Aug. 3, 1994 [CZ] Czech Rep. ..... PV 1862-94

[51] Int. Cl.[6] ..... D01H 11/00; D01H 5/28

[52] U.S. Cl. ..... 57/301; 15/346; 57/302; 57/304; 57/305

[58] Field of Search ..... 57/300, 301, 304, 57/308, 302, 261, 263, 279, 280, 303; 15/346, 319

[56] References Cited

U.S. PATENT DOCUMENTS

| | | | |
|---|---|---|---|
| 2,669,744 | 2/1954 | Parrish | 15/346 |
| 3,045,929 | 7/1962 | McEachern | 15/346 |
| 4,038,812 | 8/1977 | Stahlecker | 57/301 |
| 4,042,998 | 8/1977 | Blough et al. | 15/346 |
| 4,159,620 | 7/1979 | LaFlaquiere et al. | 57/301 |
| 4,333,201 | 6/1982 | Rohner | 15/346 |
| 5,361,572 | 11/1994 | Uematsu et al. | 57/304 |

FOREIGN PATENT DOCUMENTS

| | | | |
|---|---|---|---|
| 196227 | 12/1982 | Czech Rep. . | |
| 239041 | 11/1987 | Czech Rep. . | |
| 6322619 | 11/1994 | Japan | 57/304 |
| WO8911961 | 12/1989 | WIPO . | |

*Primary Examiner*—William Stryjewski
*Attorney, Agent, or Firm*—Dority & Manning

[57] ABSTRACT

An attending device of a textile machine, in particular of a rotor spinning machine, is provided having pneumatic pressure means intended to attend a working place and being disengageably connected to an overpressure source, and having underpressure pneumatic means disengageably connected to an underpressure source. The underpressure source and the overpressure source are made as a pneumatic generator situated on the attending device, and a closed filter of impurities mounted on the attending device is inserted before the air inlet into the pneumatic generator.

27 Claims, 4 Drawing Sheets

COMBINED PNEUMATIC YARN ATTENDING FOR TEXTILE MACHINES

BACKGROUND OF THE INVENTION

The invention relates to an attending device of a textile machine, in particular of a rotor spinning machine, having pneumatic pressure means for attending a work place and being disengageably connected to an overpressure source, and an underpressure pneumatic means disengageably connected to an underpressure source.

Known attending devices of textile machines, in particular of rotor spinning machines, include a number of mechanisms, in particular mechanisms for handling yarn when re-establishing a spinning process. In their operation, such mechanisms may make use of underpressure, for instance for detecting the yarn end on a bobbin, for cleaning the rotor, etc. For example, after arriving at the working place to be attended, the attending device is connected to the underpressure source, i.e., to its distributing mouth, by a flexible tube. For some other functions, the attending device needs pressure air, both high pressure air for high pressure control means such as pneumatic cylinders, and low pressure air, especially for supporting the yarn movement by blowing. To achieve this, high pressure air is supplied to the attending device through a hose, and throttling means are inserted before such operating sections of the attending device that require low pressure air.

Also known are cleaning devices for blowing off the machine and suctioning impurities. Such devices typically include a blower to whose outlet is connected blowing-off jets and to whose inlet are connected suction jets for suctioning impurities. Air is led from the suction jets to the blower via a filter intended to retain impurities. The filter is seated on a cleaning device which is in a well-known manner mounted so as to be able to move along the machine. In one of the end positions of the cleaning device, there is provided on the machine a device for emptying the filter, for instance as described in Czech Patent No. 239041. This arrangement of two separate devices moving along the machine has a number of drawbacks. In addition to the complicated design and manufacture, it is necessary to coordinate their mutual movement to avoid a collision between the devices that would create a risk of break-down.

The patent CS 196 227 discloses a well-known device for thread piecing and cleaning of a spinning machine in which the attending device is connected with a cleaning device by means of a pneumatic piping used to create underpressure in the attending device. The attending device and the cleaning device work independently from each other except that the impurities sucked in by the attending device are led into the filter seated in the cleaning device that is adapted to blow off the machine and to suction impurities from its surface and its surrounding zone. The cleaning device can be towed by the attending device or fitted with a separate drive.

The drawback in such an arrangement consists again in the necessity to have two devices moving along the machine, thereby increasing costs for machine manufacture and for machine maintenance and operation.

OBJECTS AND SUMMARY OF THE INVENTION

The drawbacks of the state of art are eliminated by the attending device according to the invention, a principal object of which is to provide an attending device in which the underpressure source and the overpressure source are made as a pneumatic generator situated on the attending device and in which a closed filter of impurities, mounted on the attending device, is inserted before the air inlet into the pneumatic generator. Additional objects and advantages of the invention will be set forth in part in the following description, or may be obvious from the description, or may be learned through practice of the invention.

This design arrangement of the attending device not only permits a complete integration of the attending device with the cleaning device but also simplifies the machine design by situating of the pneumatic generator on the attending device, thereby eliminating the need to dimension the travel motion rail for two travelling devices and to account for the mutual position of the attending and the cleaning device. Eliminated also is the problematic connection of the attending device to the cleaning device required for creating underpressure in the attending device. Any failure of tightness in such a connection results in disturbing the basic operational functions of the attending device required for reinstalling the spinning process on the attended working place.

To the outlet of the pneumatic generator mounted on the attending device can be connected, besides the pneumatic pressure means, machine blowing off means mounted on the attending device.

Means for suctioning dust and impurities from the machine surface may also be mounted on the attending device. The suctioning means are connected to the air inlet into the pneumatic generator via the closed filter of impurities.

The pneumatic generator can comprise an underpressure generator on whose inlet and outlet there are provided air distributing means and air amount adjusting means that are, together with the underpressure generator, connected to a control unit.

In the preceding embodiments comprising a filter of impurities, the filter is preferably seated in one side wall of the attending device.

It is also advantageous if the filter comprises a filtering member seated in the filter box.

This arrangement allows reduction of place requirements and permits sufficient space for depositing gross impurities due to the vertical position of the active filtering member on the filter of the attending device. The filtering member is accessible to the operator, and the required frequency of its cleaning is reduced to once per working shift.

In one of the preferred embodiments of the attending device, the filter is so arranged that the vertical filtering member separates the inner area of the filter into an inlet area interconnected with underpressure means and with means for suctioning dust and impurities from the machine surface and an outlet area connected with the inlet of the underpressure generator.

An underpressure sensor connected to a control unit is mounted in the inlet and/or outlet area. By monitoring the amount of impurities deposited on the filter faultless working of all the underpressure pneumatic means of the attending device may be ensured; if the underpressure exceeds a preset value, the control unit either sends a signal to call in the attending operator or stops the attending device until the filter has been cleaned.

BRIEF DESCRIPTION OF THE DRAWINGS

A full and enabling disclosure of the present invention, including the best made thereof, directed to one of ordinary skill in the art, is set forth in the specification. Examples of the embodiment of the attending device according to the invention are schematically shown in the enclosed drawings in which.

DETAILED DESCRIPTION OF PREFERRED EMBODIMENTS

Figure 1:
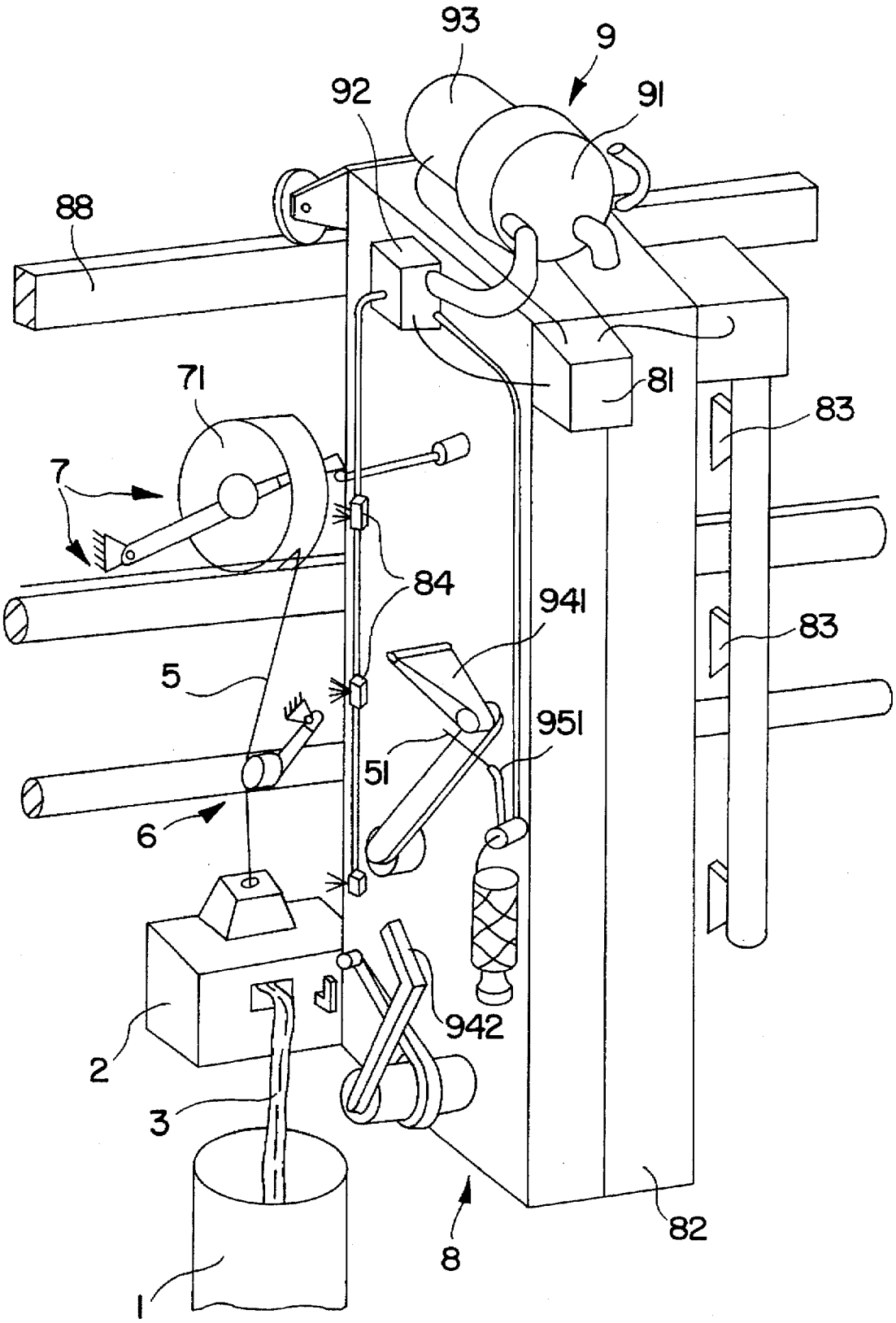
FIG. 1 is a perspective view of a part of an attending device and of one working place of the machine.
Figure 2:
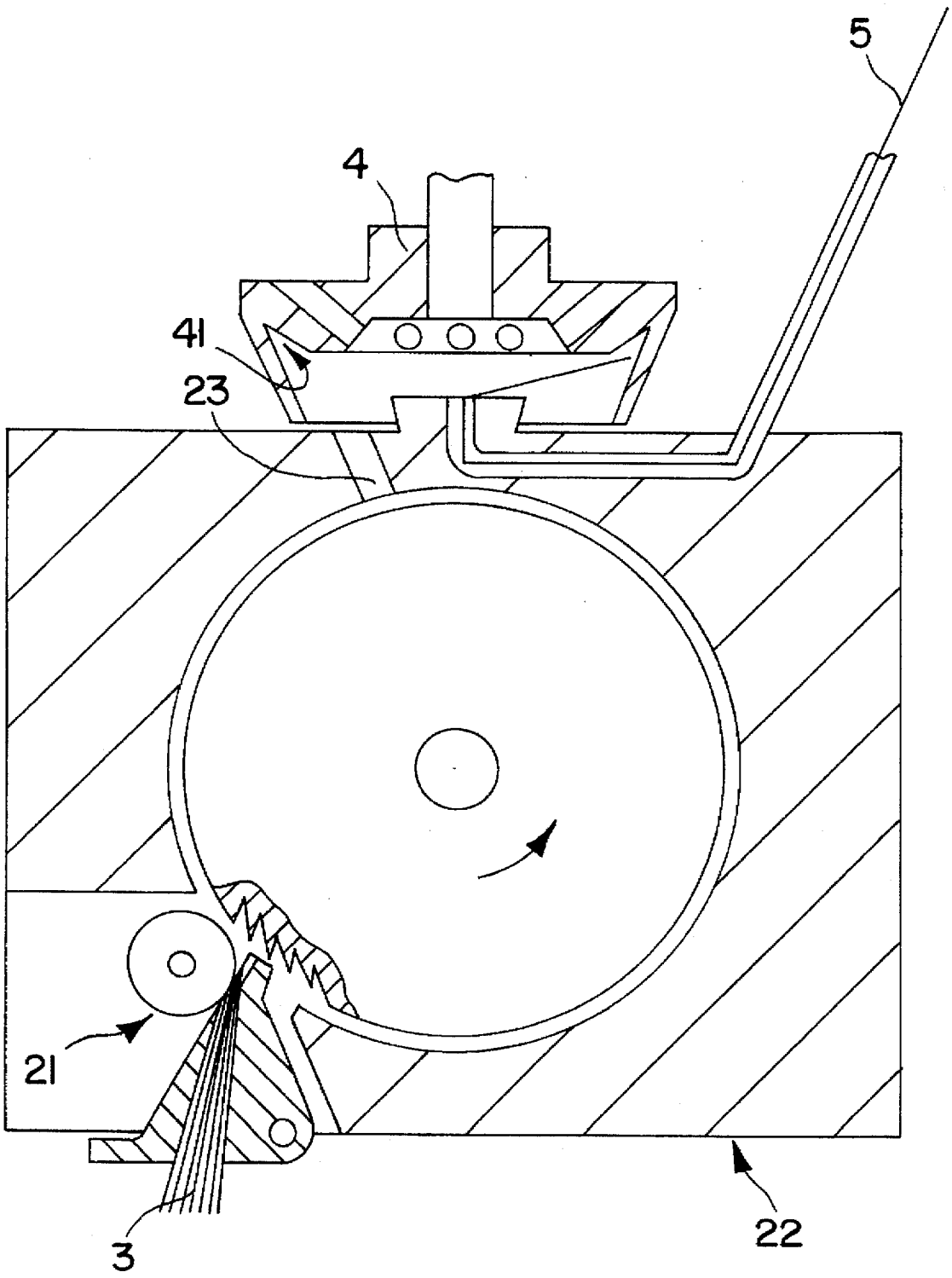
FIG. 2 is a sectional view of a spinning unit.
Figure 3:
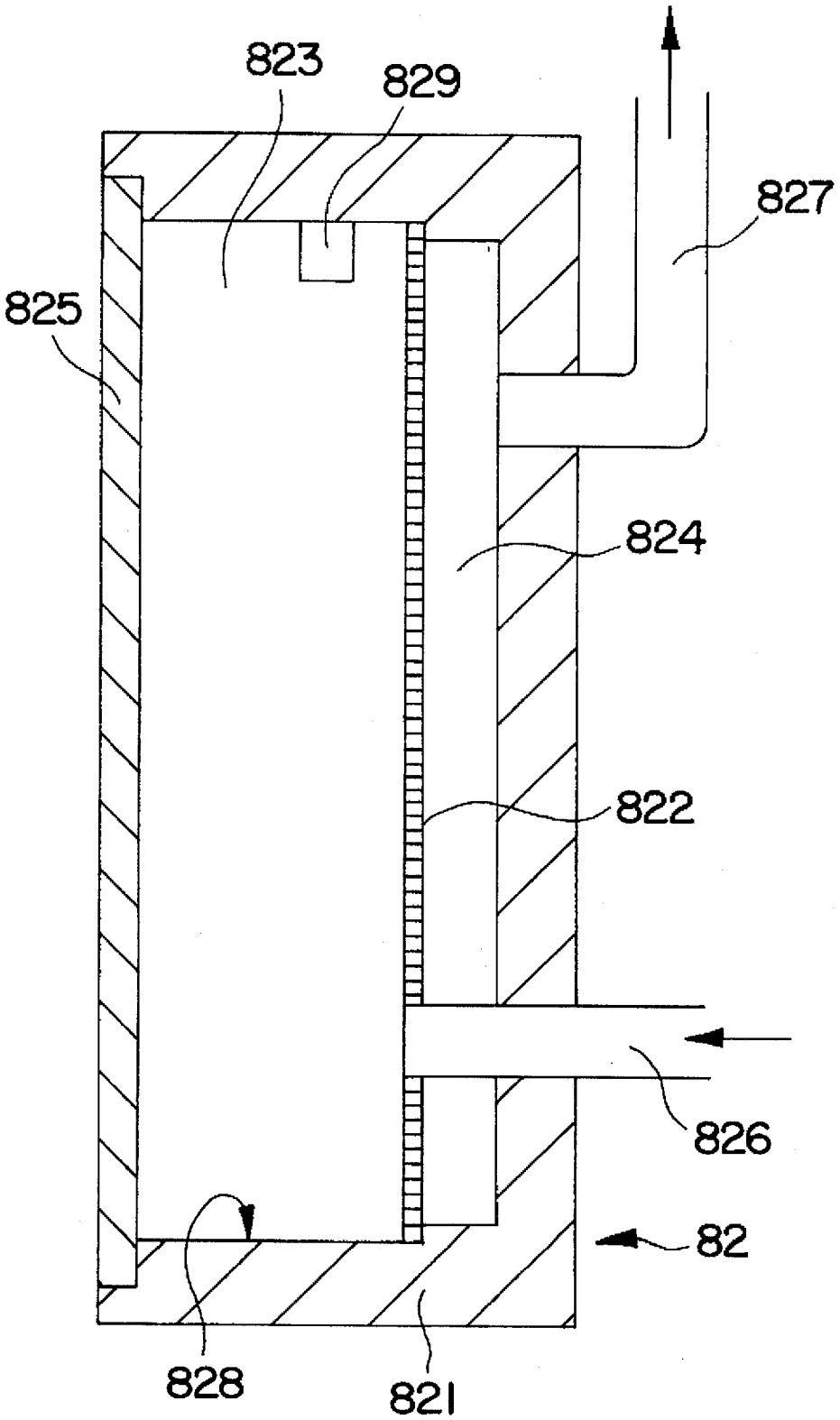
FIG. 3 is a sectional view of a filter.
Figure 4:
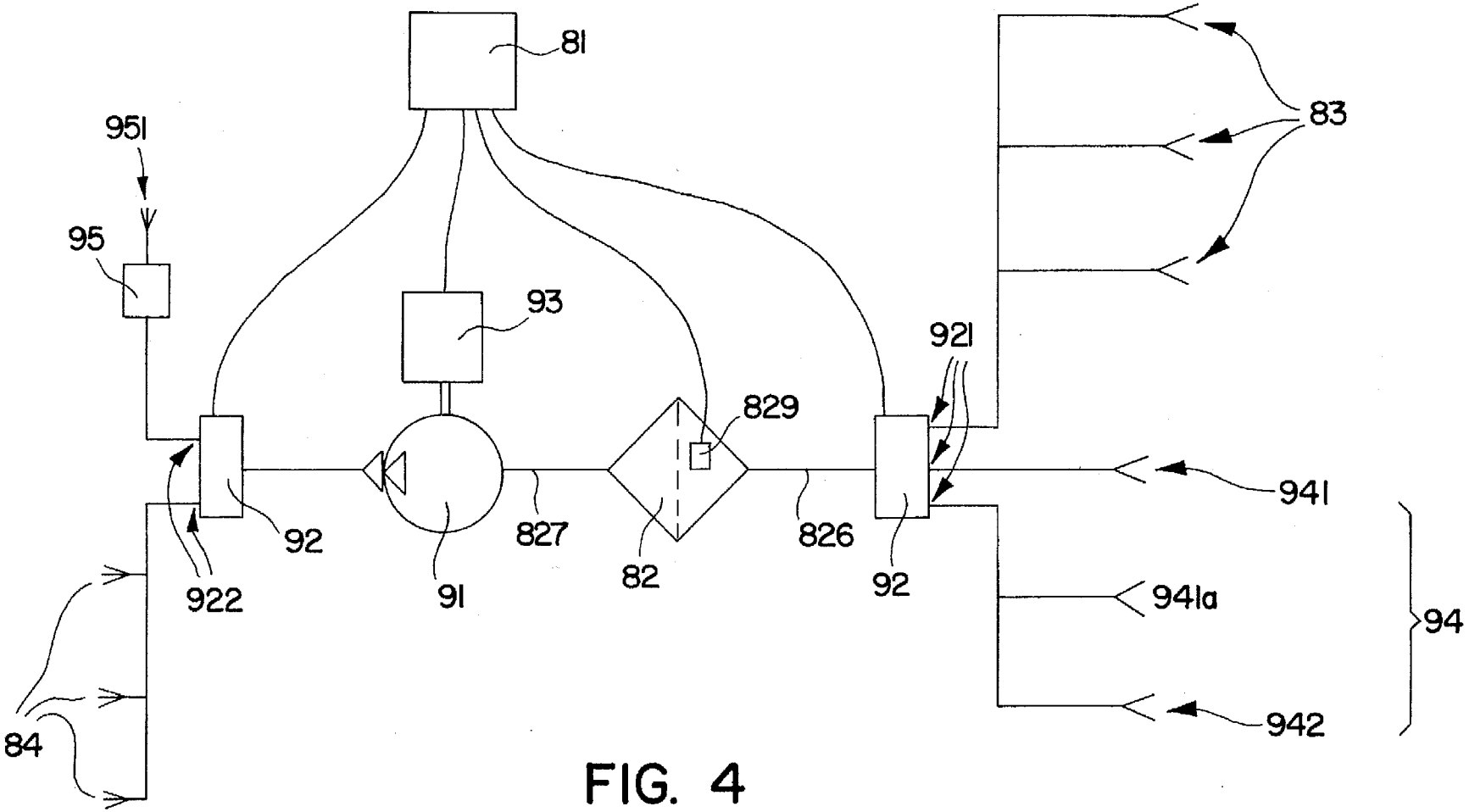
FIG. 4 is a diagrammatic view of a pneumatic circuit of the attending device.

Reference will now be made in detail to the presently preferred embodiments of the invention, one or more examples of which are illustrated in the drawings. Each example is provided by way of explanation of the invention, and not as a limitation of the invention. In fact, various modifications and variations can be made in the present invention without departing from the scope and spirit of the invention.

Textile machines, in particular rotor spinning machines, include working places arranged next to each other and out of which each serves for carrying out a complete technological process. Thus, for instance, in a rotor spinning machine, each working place transforms a textile fibre sliver to yarn.

To achieve this, each working place of the machine includes a sliver can 1 of a spinning unit 2 equipped with a feed mechanism 21 of a sliver 3. A singling out mechanism 22 is connected by means of a singled out fibre feeding channel 23 with a rotor 4 in which the singled out fibres are in a well-known manner collected and on whose collecting surface 41 they are in a well-known manner deposited into a fibre band (not shown) to be transformed by the revolving motion of the rotor 4 into yarn 5 that is drawn off from the rotor 4 by a well-known draw-off mechanism 6 and wound on a bobbin 71 by an also well-known winding up motion 7.

An attending device 8, arranged to travel along the working places of the machine, is seated on a travel motion rail 88 provided along the whole length of the machine. In a double-sided machine, the travel motion rails 88 are provided on both machine sides and are interconnected by a bend at least at one machine end so that the attending device 8 can attend the working places on each machine side.

On the attending device is seated a pneumatic generator 9 including an underpressure generator 91 on whose inlet and outlet is arranged an air distributing device 92 and adjustment means of air flow through the underpressure generator 91, for instance throttling means, interconnected with a control unit 81 of the attending device 8. The underpressure generator can be made as a blower or as a vacuum pump. The distributing device 92 consists of a system of inlet distributing means 921 and of a system of outlet distributing means 922 interconnected with the control unit 81 of the attending device 8. The underpressure generator 91 is fitted with a drive motor 93 coupled with the control unit 81 of the attending device 8.

To the inlet of the underpressure generator 91 there are connected, via a closed filter 82 mounted on the attending device 8 and via the inlet distributing means 921 of the distributing device 92, pneumatic underpressure means 94. Pneumatic underpressure means 94 may consist, for instance, of a yarn detecting jet 941, a suction tube 942 of the cleaning device of the rotor, or a suction compensator (not shown) and of other well-known means 941*a* for supporting the motion of the yarn 5 by suction when attending a working place of the machine.

Also attached to the inlet of the underpressure generator 91 via filter 82 and via the related inlet distributing means 921 of the distributing device 92 are suction means 83 for removing dust and impurities from the machine surface. Suction means 83 is mounted on the attending device 8.

The filter 82 is seated on one side wall of the attending device 8 and includes a filter box 821 in which is vertically arranged a filtering member 822 separating the inner area of the filter 82 into an inlet area 823 and an outlet area 824. The inlet area 823 is closed from the outer side by a cover 825 removably seated in the filter box 821. Cover 825 is preferably transparent so as to enable the operator to observe the amount of impurities deposited on the filter 82. Entering the inlet area 823 of the filter 82 is the mouth of an inlet pipe 826 serving to bring in the suctioned air carrying fibres and impurities removed from the machine surface by suction means 83 and the suctioned air from the underpressure means 94. The outlet area 824 of the filter 82 is connected by means of a connecting pipe 827 with the inlet of the underpressure generator 91. Between the inlet pipe 826 and the bottom 828 of the box 821 of the filter 82 there is provided room for collecting gross impurities.

To the outlet of the generator 91 are connected, via the related outlet distributing means 922 of the distributing device 92, pneumatic pressure means 95, consisting for instance of a jet 951 for holding the end of ancillary yarn 51 in its hand-over position, or a pressure compensator (not shown), or other means for keeping the yarn 5 or the ancillary yarn 51 in a predetermined direction by air stream. To the outlet of the generator 91 are connected, via the related outlet distributing means 922, means 84 seated on the attending device 8 and serving for blowing off the machine by pressure air.

The control unit 81 controls all functions of the attending device 8, both in servicing the elements of a working place and during the travel from the working place that has just been attended to to a next working place in need of attendance. Motor 93 of the underpressure generator 91 is operating during all such functions.

During the attendance of a working place, the control unit 81 or other suitable control device not only controls the mechanisms and means of the attending device 8 but also engages the related inlet and outlet distributing means 921 and 922 of the distributing device 92, thus providing the supply of underpressure and/or pressure air to the related mechanism or means of the attending device 8. The intensity of the under- or overpressure is adjusted by means of well-known air flow adjusting means, for instance by means of throttling means.

When the attendance of a working place has been finished, the control unit 81 engages the related inlet distributing means 921 and outlet distributing means 922 of the underpressure generator 91, thus starting the pressure air supply to the machine blowing-off means 84. Simultaneously, means 83 for removing dust and impurities from the machine surface suction air together with the impurities that have been whirled up by the blowing-off action. This suctioned air is led to the filter 82 in which the impurities are caught and collected. The blowing off of the machine and the suctioning of impurities continues until the travel motion of the attending device 8 is finished and the attendance of the next working place begins.

Air with fibres and other impurities suctioned by pneumatic underpressure means 94 or by the suction means 83 for removing dust and impurities from the machine surface is led through the inlet pipe 826 into the inlet area 823 of the filter 82. Gross impurities such as yarn fall to the bottom 828 of the box 821 of the filter 82 while the other impurities and fibres are caught by the filtering member 822. These impurities and fibres are collected on the sector of the most intensive action of the underpressure as the air flows through filtering member 822. The gradually increasing amount of impurities deposited on the filtering member 825 gradually displaces the sector of the most intensive action of the underpressure so as finally to cover the whole of its filtering area whose size is not much inferior to that of the side wall of the attending device 8, thus permitting reduction of the cleaning frequency of the filtering member 822 to once per shift at the most. The operator can clean the filtering member 822 manually.

The monitoring of underpressure in the inlet area 823 of the filter 82 is provided for by a sensor 829 signalling the operator when the underpressure drops below a predetermined limit.

In other preferred embodiments, the underpressure sensor 829 connected to the control unit 81 can be situated in the outlet area 824 of the filter 82. It is also possible to make use of two underpressure sensors 829 situated one in the inlet area 823, and the other in the outlet area 824, of the filter 82.

It will be apparent to those skilled in the art that various modifications and variations can be made in the present invention without departing from the scope and spirit of the invention. For example, features illustrated or described as part of one embodiment can be used in another embodiment to yield a still further embodiment. It is intended that the present invention cover such modifications and variations as come within the scope of the appended claims and their equivalents.

We claim:

1. A textile machine attending assembly to be disposed proximate the textile machine to perform attending operations thereto, said assembly comprising:

an attending unit configured to travel along the textile machine;

a pneumatic pressure generator disposed on said attending unit, said pneumatic pressure generator having an outlet and an inlet and generating a negative pneumatic pressure at said inlet and a positive pneumatic pressure at said outlet;

at least one positive pneumatic pressure cleaning mechanism and at least one yarn handling mechanism in communication with said pneumatic pressure generator outlet, said positive pneumatic pressure mechanisms performing one of a predetermined yarn handling operation and cleaning operation at the textile machine which requires a source of pressurized air;

at least one negative pneumatic pressure cleaning mechanism and at least one yarn handling mechanism in communication with said pneumatic pressure generator inlet, said negative pneumatic pressure mechanisms performing one of a predetermined yarn handling operation and cleaning operation at the textile machine which requires a source of negative pressure air;

a control device in communication with said positive pneumatic pressure mechanisms and said negative pneumatic pressure mechanisms to selectively operate said mechanisms for said yarn handling and cleaning operations; and an air filter mechanism disposed upstream from said pneumatic pressure generator inlet to filter air entering said inlet from said negative pneumatic pressure mechanisms, wherein-the filtered air is directed to said positive pneumatic pressure mechanisms.

2. The attending assembly as in claim 1, wherein at least one of said positive pneumatic pressure cleaning mechanisms includes an air passage outlet configured to direct an air stream to at least a portion of the textile machine to blow debris therefrom.

3. The attending assembly as in claim 1, wherein at least one of said negative pneumatic pressure cleaning mechanisms includes an air passage inlet configured to draw air from an area adjacent the textile machine to suck debris therefrom.

4. The attending assembly as in claim 1, including an air distributing mechanism disposed in part upstream from said pneumatic pressure generator inlet and in part downstream from said pneumatic pressure generator outlet, said air distributing mechanism configured to direct air flow, responsively to said control mechanism, to said pneumatic pressure generator inlet selectively from said negative pneumatic pressure mechanisms and from said pneumatic pressure generator outlet selectively to said positive pneumatic pressure mechanisms.

5. The attending assembly as in claim 1, including an air flow regulating mechanism disposed downstream from said pneumatic pressure generator outlet, said air flow regulating mechanism configured to regulate, responsively to said control mechanism, the intensity of the air flow from said pneumatic pressure generator outlet to said positive pneumatic pressure generator mechanisms.

6. The attending assembly as in claim 1, wherein said air filter mechanism is disposed on a side wall of said attending unit.

7. The attending assembly as in claim 6, wherein said air filter mechanism includes a vertical filtering member disposed in a filter box.

8. The attending assembly as in claim 7, wherein said vertical filtering member divides the interior of said filter box into an inlet area and an outlet area, said inlet area configured to receive air flow from said negative pneumatic pressure mechanisms and said outlet area configured to output air to said pneumatic pressure generator inlet such that air drawn from said negative pneumatic pressure mechanism is filtered by said vertical filtering member and output by said pneumatic pressure generator to said positive pneumatic pressure mechanism.

9. The assembly as in claim 8, wherein said control mechanism is configured to detect, via a pressure sensing device in communication with the interior of said filter box and with said control mechanism, when pressure in said filter box interior reaches a predetermined level.

10. The assembly as in claim 8 wherein said pressure sensing device is disposed in communication with said inlet area of said filter box interior.

11. A textile machine attending assembly configured to be disposed proximate the textile machine to perform attending operations thereto, said assembly comprising:

an attending unit configured to travel along the textile machine;

a pneumatic pressure generator disposed on said attending unit, said pneumatic pressure generator having an outlet and an inlet and generating negative pneumatic pressure at said inlet and positive pneumatic pressure at said outlet;

a control mechanism in communication with said pneumatic pressure generator and selectively controlling the operation thereof;

at least one positive pneumatic pressure yarn handling mechanism in communication with said pneumatic pressure generator outlet, said positive pneumatic pressure handling mechanisms performing a predetermined yarn handling operation at the textile machine;

a plurality of positive pneumatic pressure cleaning mechanisms in communication with said pneumatic pressure generator outlet, said positive pneumatic pressure cleaning mechanisms removing debris from at least a portion of the textile machine;

a plurality of negative pneumatic pressure yarn handling mechanisms in communication with said pneumatic pressure generator inlet, said negative pneumatic pressure handling mechanisms performing predetermined yarn handling operations at the textile machine;

a plurality of negative pneumatic pressure cleaning mechanisms in communication with said pneumatic pressure generator inlet, said negative pneumatic pressure cleaning mechanisms including air passage inlets drawing air from an area adjacent the textile machine to remove debris therefrom; and an air filter mechanism disposed upstream from said pneumatic pressure generator inlet to filter air entering said inlet from said negative pneumatic pressure handling mechanisms and said negative pneumatic pressure cleaning mechanisms, wherein the filtered air is directed to said positive pneumatic pressure handling mechanisms and said positive pneumatic pressure cleaning mechanisms.

12. The handling assembly as in claim 11, wherein said plurality of positive pneumatic pressure cleaning mechanisms includes a plurality of air passage outlets configured to direct an air stream to at least a portion of the textile machine.

13. The handling assembly as in claim 11, wherein said at least one positive pneumatic pressure handling mechanism includes a yarn directing device.

14. The handling assembly as in claim 11, wherein said plurality of negative pneumatic pressure handling mechanisms includes a yarn detecting jet.

15. The handling assembly as in claim 11, wherein said plurality of negative pneumatic pressure handling mechanisms includes a rotor cleaning device.

16. The attending assembly as in claim 11, wherein said plurality of negative pneumatic pressure handling mechanisms includes a yarn supporting device.

17. A textile machine having a plurality of working stations, said machine comprising:

a machine frame; and an handling assembly disposed on said frame to travel therealong proximate the working stations to perform handling operations thereto, said assembly comprising an handling unit configured to travel along said machine frame, a pneumatic pressure generator disposed on said handling unit, said pneumatic pressure generator having an outlet and an inlet and generating a negative pneumatic pressure at said inlet and a positive pneumatic pressure at said outlet, at least one positive pneumatic pressure cleaning mechanism and yarn handling mechanism in communication with said pneumatic pressure generator outlet, said positive pneumatic pressure mechanisms performing one of a predetermined yarn handling operation and cleaning operation at a working station, at least one negative pneumatic pressure cleaning mechanism and yarn handling mechanism in communication with said pneumatic pressure generator inlet, said negative pneumatic pressure mechanisms performing one of a predetermined yarn handling operation and cleaning operation at a working station, and an air filter mechanism disposed upstream from said pneumatic pressure generator inlet to filter air entering said inlet from said negative pneumatic pressure mechanisms, wherein the filtered air is directed to said positive pneumatic pressure mechanisms.

18. The textile machine as in claim 17, wherein at least one of said positive pneumatic pressure cleaning mechanisms includes an air passage outlet configured to direct an air stream to at least a portion of the working station to remove debris therefrom.

19. The textile machine as in claim 17, wherein at least one of said negative pneumatic pressure cleaning mechanisms includes an air passage inlet configured to draw air from an area adjacent the working station to remove debris therefrom.

20. The textile machine as in claim 17, including a control mechanism in communication with said pneumatic pressure generator and configured to selectively control the operation thereof.

21. The textile machine as in claim 20, including an air flow regulating mechanism disposed downstream from said pneumatic pressure generator outlet, said air flow regulating mechanism configured to regulate, responsively to said control mechanism, the intensity of the air flow from said pneumatic pressure generator outlet to said positive pneumatic pressure generator mechanisms.

22. The textile machine as in claim 17, including an air distributing mechanism disposed in part upstream from said pneumatic pressure generator inlet and in part downstream from said pneumatic pressure generator outlet, said air distributing mechanism configured to direct air flow, responsively to said control mechanism, to said pneumatic pressure generator inlet selectively from said negative pneumatic pressure mechanisms and from said pneumatic pressure generator outlet selectively to said positive pneumatic pressure mechanisms.

23. The textile machine as in claim 17, wherein said air filter mechanism is disposed on a side wall of said handling unit.

24. The textile machine as in claim 23 wherein said air filter mechanism includes a vertical filtering member disposed in a filter box.

25. The textile machine as in claim 24, wherein said vertical filtering member divides the interior of said filter box into an inlet area and an outlet area, said inlet area configured to receive air flow from said negative pneumatic pressure mechanisms and said outlet area configured to output air to said pneumatic pressure generator inlet such that air drawn from said negative pneumatic pressure mechanisms is filtered by said vertical filtering member and output by said pneumatic pressure generator to said positive pneumatic pressure mechanisms.

26. The assembly as in claim 25, wherein said control mechanism is configured to detect, via a pressure sensing device in communication with the interior of said filter box and with said control mechanism, when pressure in said filter box interior reaches a predetermined level.

27. The assembly as in claim 25, wherein said pressure sensing device is disposed in communication with said inlet area of said filter box interior.

* * * * *